US010337300B2

(12) United States Patent
Davidson

(10) Patent No.: US 10,337,300 B2
(45) Date of Patent: Jul. 2, 2019

(54) METHOD TO CONTROL ENERGY INSIDE A PERFORATION GUN USING AN ENDOTHERMIC REACTION

(71) Applicant: Halliburton Energy Services, Inc., Houston, TX (US)

(72) Inventor: Justine M. Davidson, Burelson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 80 days.

(21) Appl. No.: 15/301,678

(22) PCT Filed: May 8, 2014

(86) PCT No.: PCT/US2014/037298
§ 371 (c)(1),
(2) Date: Oct. 3, 2016

(87) PCT Pub. No.: WO2015/171150
PCT Pub. Date: Nov. 12, 2015

(65) Prior Publication Data

US 2017/0037712 A1 Feb. 9, 2017

(51) Int. Cl.

| | |
|---|---|
| ***F42D 1/00*** | (2006.01) |
| ***F42D 1/02*** | (2006.01) |
| ***E21B 43/117*** | (2006.01) |
| ***E21B 43/119*** | (2006.01) |

(52) U.S. Cl.
CPC ..... *E21B 43/117* (2013.01); *E21B 43/119* (2013.01); *F42D 1/00* (2013.01); *F42D 1/02* (2013.01)

(58) Field of Classification Search
CPC ..... E21B 43/11–43/1195
See application file for complete search history.

(56) References Cited

U.S. PATENT DOCUMENTS 3,747,679 A * 7/1973 Roberts ..... E21B 43/26 102/301
5,257,755 A 11/1993 Moser et al.
(Continued)

OTHER PUBLICATIONS

International Search Report and Written Opinion dated Feb. 6, 2015, issued is corresponding application No. PCT/2014/037298, 2 pgs.

*Primary Examiner* — Blake E Michener
(74) *Attorney, Agent, or Firm* — Chamberlain Hrdlicka

(57) ABSTRACT

A wellbore perforation gun includes a gun housing, a plurality of charges, a first reactive material, and a second reactive material that is reactive with the first reactive material to generate an endothermic chemical reaction to drop the potential energy (in the form of temperature or pressure) of the gun housing. The perforation gun may further include a controller and a release capsule, with the first reactive material being disposed within the release capsule and the second reactive material being disposed within a chamber of the gun housing at a first time. The controller may be communicatively coupled to the release capsule and operable to generate a signal to the release capsule at a second time that is later than the first time. The release capsule may be operable to release the first reactive material into the chamber response to receiving the signal.

17 Claims, 3 Drawing Sheets

(56) References Cited

U.S. PATENT DOCUMENTS

| | | | | |
|---|---|---|---|---|
| 7,431,075 | B2 * | 10/2008 | Brooks | E21B 43/263 102/275.5 |
| 2003/0037692 | A1 * | 2/2003 | Liu | C06B 33/00 102/301 |
| 2005/0236183 | A1 * | 10/2005 | Grove | E21B 43/119 175/4.6 |
| 2008/0134925 | A1 * | 6/2008 | Konig | E21B 43/118 102/307 |
| 2009/0159283 | A1 | 6/2009 | Fuller et al. | |
| 2009/0272529 | A1 | 11/2009 | Crawford | |
| 2010/0132945 | A1 * | 6/2010 | Bell | E21B 43/117 166/297 |
| 2010/0147523 | A1 | 6/2010 | Difoggio | |
| 2010/0147587 | A1 * | 6/2010 | Henderson | E21B 43/117 175/2 |
| 2013/0008183 | A1 | 1/2013 | Huettner et al. | |
| 2013/0008655 | A1 | 1/2013 | Le et al. | |
| 2014/0069647 | A1 * | 3/2014 | Daly | E21B 43/11 166/297 |

* cited by examiner

METHOD TO CONTROL ENERGY INSIDE A PERFORATION GUN USING AN ENDOTHERMIC REACTION

FIELD OF THE INVENTION

The present disclosure relates generally to methods for manufacturing and operating perforation guns for use in the formation of hydro-carbon producing wells.

DISCUSSION OF THE RELATED ART

In the early stage of developing a well, a drilling string is deployed into a hydrocarbon-producing formation to remove material to form a wellbore. Following completion of the wellbore, a casing may be installed in the wellbore to convey fluids from the formation to the surface where it is collected for production. The casing may be formed by connecting together a series of metal or cement tubes or casing segments that are installed in the wellbore. The casing reinforces the wellbore, prevents collapse, and forms a fluid flow path for conveying fluids to the surface. Once the casing is cemented in place in the wellbore, openings may be formed in portions of the casing that are adjacent the hydrocarbon-producing formation to allow fluids to flow into the casing from the formation and up toward the surface of the well.

The aforementioned openings may also be referred to as "perforations", and may be formed by deploying a perforation gun into the portion of the casing that is to be perforated. The perforation gun may include a series of shaped, explosive charges that are detonated to generate an explosion into the casing and formation to form a plurality of openings in the casing and tunnels in the formation. The openings in the casing and tunnels in the formation allow fluid to flow from the formation into the casing and upward toward the surface.

BRIEF DESCRIPTION OF THE DRAWINGS

Illustrative embodiments of the present invention are described in detail below with reference to the attached drawing figures, which are incorporated by reference herein and wherein.

Figure 1:
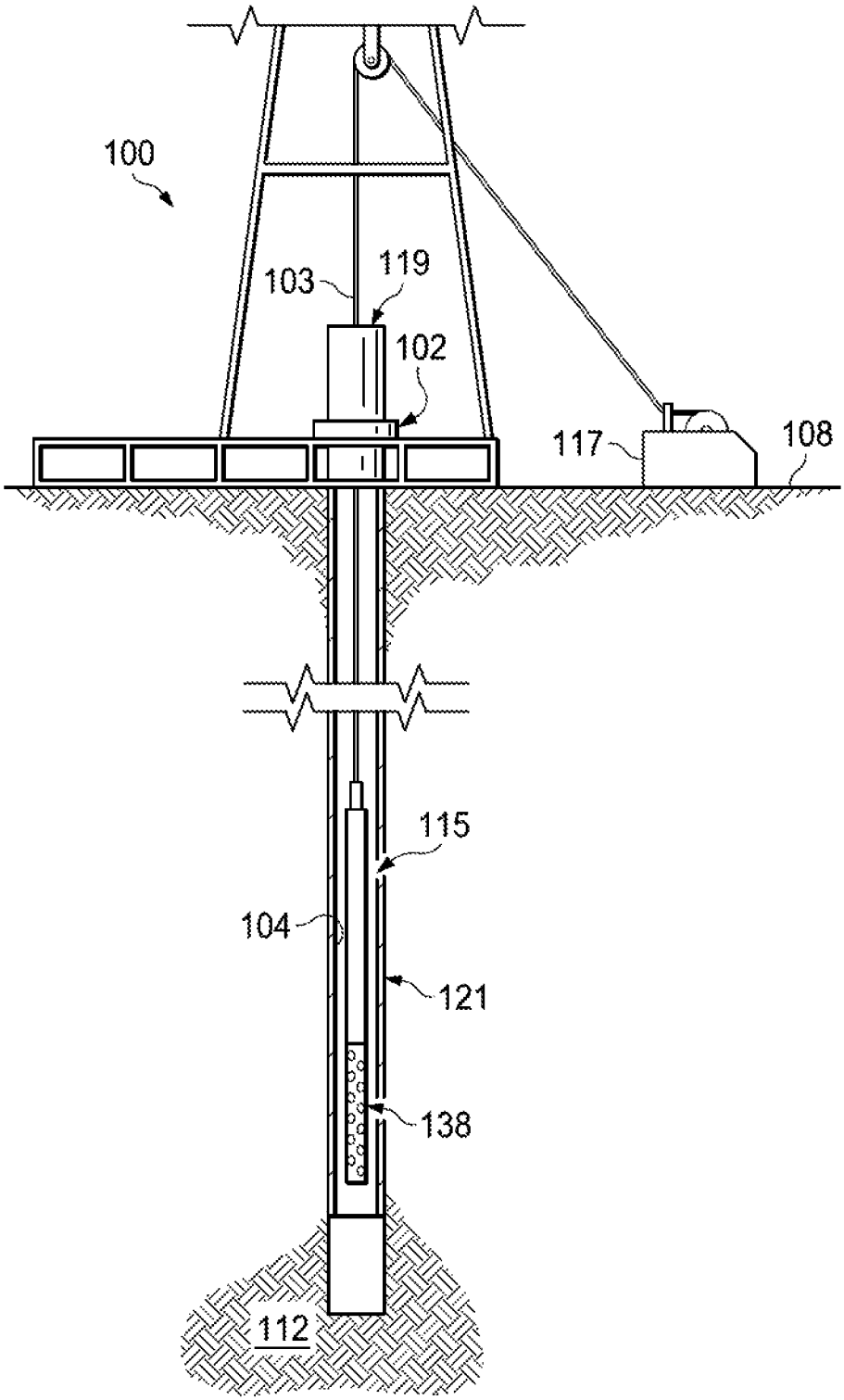
FIG. 1 is a schematic, side view of a tool string having a perforation gun extending into a wellbore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention. It is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As noted above, to enable the production of fluids from a well, charges are detonated from a perforation gun to provide openings in the casing and formation through which fluid may flow into the casing. Such openings may be referred to herein as "perforations." These perforations may be created by detonating a plurality of charges located within one or more perforation guns that are deployed within the casing within the hydrocarbon-production formation.

In an embodiment, the perforation guns include a fluidly sealed, enclosed perforation gun housing that includes a coupling to allow the perforation gun to be deployed in the casing by wire line or tubing or a similar conveyance. Each perforation gun includes a plurality of charges deployed within the perforation gun housing on a charge holder that supports the charges and orients the charges such that when the charges are actuated, an explosion will be directed through a desired portion of the perforation gun housing and into the formation. The charges may be shaped charges that constrain the explosive material of the charge in a conical configuration to direct the explosion along a desired path into the formation. Typically, each perforation gun also includes a control cord, or detonation cord, coupled to each charge that actuates the charges. The control cord conveys a mechanical, electrical, or hydraulic control signal that actuates the charges in the event of detonation.

Upon detonation, a detonated charge produces a jet-like explosion that penetrates the perforation gun housing and wall of the casing before forming a tunnel in the formation. In the interest of maximizing the magnitude of the explosion at the formation, resistance to the explosion provided by the perforation gun housing may be reduced by forming scallops in the perforation gun housing adjacent to the charge. As referenced herein, a scallop is a portion of the perforation gun housing that has a reduced wall thickness relative to the nominal thickness of the perforation gun housing. The scallops may be formed in the exterior or interior of a wall that forms the gun body.

When deployed, the perforation gun may be subjected to relatively high external temperatures and high pressures within the well, subjecting the perforation gun housing to thermal and pressure induced loads. Such loads may result from an imbalance between the temperature within the gun housing and the temperatures in the wellbore at the depth at which the perforation gun is deployed (a temperature imbalance), an imbalance between the pressure within the gun housing and the pressure in the wellbore at the depth at which the perforation gun is deployed (a pressure imbalance), or from forces resulting from detonation of the charges. Such loads may result in material stresses that cause cracking or excessive deformation of the perforation gun housing when a charge is detonated, including swelling, fracture, fragmentation, crack propagation, catastrophic rupturing or splitting of the perforation gun housing.

Such fracture or excessive deformation may result in the perforation gun housing becoming stuck in the well or disconnected from the tool string, which may in turn cause the operator to fish fractured portions of the perforation gun housing from the casing before production can begin. This process may delay production and result in increased costs to the well operator.

In addition to increased risk of fracture upon detonation, high well temperatures may induce warming in the perforation gun and its charges which, in addition to pre-existing temperature imbalances, may contribute to decreased performance of the charge when the perforation gun is detonated.

Systems and methods for enhancing the performance and durability of a perforation gun by lowering the energy level within the gun housing prior to detonation and/or after detonation are disclosed below. Lowering the energy level may be accomplished by reducing the temperature of gas within the gun housing, by decreasing the pressure in the housing, or a combination thereof.

According to an illustrative embodiment, a perforation gun includes a gun housing and a plurality of charges. The perforation gun further includes a first reactive material and a second reactive material that is reactive with the first reactive material to generate an endothermic chemical reaction to absorb heat and reduce temperature or pressure within the body of the perforation gun. The perforation gun may also include a controller and a release capsule. The first reactive material may be disposed within the release capsule and the second reactive material may be disposed within a chamber of the gun housing prior to release of the reactive material. In an embodiment, the controller is communicatively coupled to the release capsule and operable to generate a control signal to the release capsule to cause the release capsule to release the first reactive material into the chamber where it endothermically reacts with the second reactive material.

In an embodiment, the release capsule may release the first reactive material after the detonation of the charges. In another embodiment, however, the release capsule may release the first reactive material before the detonation of the charges. The perforation gun may also include a sensor coupled to the controller, and the controller may be operable to generate the control signal in response to a trigger event that is detected by the sensor. The trigger event may be detonation of the charges, receipt of a voltage impulse or other signal from a surface controller via a control line, the temperature of the release capsule reaching a threshold temperature, or the hydrostatic pressure near the sensor reaching a threshold pressure. Accordingly, the sensor may be an accelerometer, an onboard controller coupled to a transceiver, a temperature sensor or thermometer, a pressure sensor, or any other suitable sensor.

The first reactive material may be a fluid, such as a gas or liquid, and may be pressurized or compressed win the release capsule so that it can be sprayed or otherwise dispersed to react with the second reactive material. The first reactive material may also be a powder dispersed by, for example an explosive. Similarly, the second reactive material may be a fluid, a powder, or a coating applied to the interior of the chamber of the perforation gun or released from a release capsule. The release capsule may be a pressurized chamber and a nozzle, or an open or sacrificial chamber that includes a secondary explosive and is configured to fragment or disintegrate upon detonation of the secondary explosive or a trigger event.

The first reactive material may and second reactive material may be formed from any suitable combination that produces an endothermic reaction of a desired magnitude. For example, the first reactive material and second reactive material, respectively, may be any of the following pairings: (1) water and ammonium chloride, (2) water and potassium chloride, (3) water and ammonium nitrate, (4) ethanoic acid and sodium carbonate, (5) water and carbon dioxide (as the first reactive material) and chlorophyll (as the second), (6) dry ammonium chloride and barium hydroxide octahydrate crystals, and (7) thionyl chloride and cobalt (II) sulfate heptahydrate.

Referring now to the figures, FIG. 1 shows a schematic view of a well 100 in which a wellbore 104 extends from the surface 108 through a geological formation 112 that is expected to produce hydrocarbons. A perforation string 115, which includes one or more perforation guns 138, has been deployed within the wellbore 104 by wireline 103 and is coupled to a control system 119 at the sealed well head 102. As shown in FIG. 1, the perforation string 115 is lowered into a casing 121 that has been cemented into the formation 112 by a winch 117 that lowers and raises the perforation string 115 within the wellbore 104. While FIG. 1 depicts a land-based rig 106 from which the perforation string 115 is deployed, it is noted that the perforation string 115 may be similarly deployed from a floating platform in the case of a subsea well or from another type of conveyance. Similarly, while FIG. 1 shows a vertical well it is noted that the perforation string may be similarly deployed in other well configurations, including multilateral wells, horizontal wells, inclined wells, and deviated wells.

Figure 2:
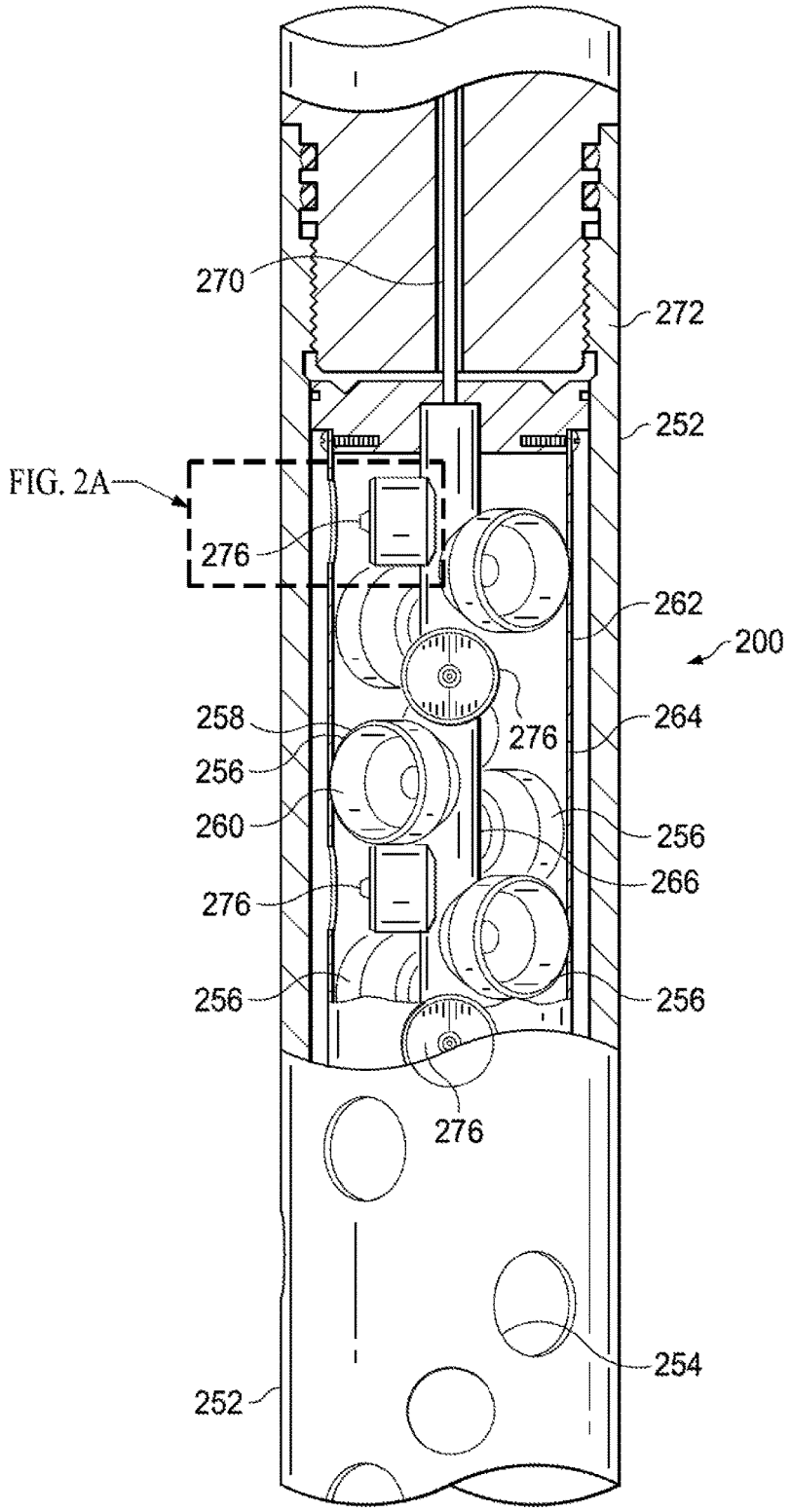
FIG. 2 is a schematic, side view, in partial cross section, of a perforation gun and housing that includes a plurality of reactive charges.

FIG. 2 shows a perforation gun 200 that is analogous to the perforation gun 138 shown in FIG. 1. The perforation gun 200 includes a perforation gun housing 252, which may be a cylindrically shaped housing having a wall 272 of a nominal thickness. The perforation gun housing may be formed from a steel alloy or any other suitable material. In an embodiment, the gun housing is constructed of a high-strength material, such as Grade A steel, alloy steel, stainless steel, or a chromium or super chromium grade stainless steel alloy (13CrM and 13CrS). The steel may be thermomechanically processed to have a selected strength level.

In an embodiment, the perforation gun housing 252 includes a plurality of scallops 254 which may be understood to be recesses or reduced-thickness areas of the perforation gun housing 252. The perforation gun 200 includes charges 256 that are substantially radially aligned with the scallops 254 to direct an explosion emanating from the charges 256 through the scallops 254 upon detonation. Each charge 256 is shown as having a frustoconical shape and includes an outer housing 258, liner 260, and an explosive composition disposed therein. When the perforation gun 200 is actuated, the liners 260 of the charges 256 form jets that pass through the scallops 254 and form perforations or tunnels that extend outwardly through the perforation gun, casing, and a desired depth into the adjacent formation.

In addition to, or in place of one or more of the charges 256, the perforation gun 200 also includes one or more containers that include a reactive material. In the embodiment of FIG. 2, the containers are represented by release capsules 276. The release capsules 276 include and are operable to emit a reactive material that is reactive with a second reactive material to create an endothermic reaction as described in more detail below. In an embodiment, the release capsules 276 are similar in quantity to the charges 256. It is noted, however, that the release capsules and amount of reactive material stored therein may be selected to deliver a desired change in temperature or pressure within the gun housing. As such, a variety of sizes and quantities of release capsules 276 may be used to deliver the desired amount of reactive material as necessary to provide the desired temperature or pressure drop. In an embodiment, the release capsule may be evenly spaced throughout the perforation gun housing 252 to provide a relatively uniform desired temperature or pressure drop throughout the perforation gun housing 252.

The perforation gun 200 also includes a charge support structure 262 that holds the charges 256 and release capsules 276 in place within the perforation gun housing 252 at desired locations. The charge support structure 262 includes an inner sleeve 266 and an outer sleeve 264 that enclose the charges 256. In an embodiment, the outer sleeve 264 supports the outer, open ends of the charges 256 and the inner sleeve 266 supports the opposing, conical end of the charges 256, which may also be referred to as the initiation ends. A control line 270, which may be a detonator control line formed from, for example, Primacord, is disposed within the inner sleeve 266 and operable to actuate the charges 256 to cause detonation. In an embodiment, the initiation ends of the charges 256 extend toward the center of the perforation gun to intersect with and connect to the control line 270 via an opening in the inner sleeve 266.

The release capsules 276 may be configured to release a reactive material to interact with a second reactive material in an annulus formed between the charge support structure 262 and outer housing 258 within the charge support structure, or in both areas. In an embodiment in which the release capsule 276 releases the reactive material to interact with the second reactive material within the charge support structure, the release capsules 276 may be sized to release the reactive materials at a distance from the wall of the charge support structure 262 that allows the reactive material to diffuse within the charge support structure 262. In such an embodiment, the second reactive material may be suspended within or coated onto the interior surface of the charge support structure 262 or similarly released from release capsules 276 that contain only the second reactive material. In an embodiment in which the release capsule 276 releases the reactive material to interact with the second reactive material in the annulus between the support structure 262, the release capsules 276 may be sized to release the reactive materials through an opening in the charge support structure 262, and may therefore have a length that is equivalent to the distance between the inner sleeve 266 and outer sleeve 264. In such an embodiment, the outer sleeve 264 may be formed with openings or apertures that coincide with the locations of the release capsules 276, and the second reactive material if not released from release capsules 276, may be suspended within the annulus or applied as a coating to at least one of the exterior of the charge support structure 262 and the interior surface of the gun housing 252.

The charges 256 may be arranged in a helix so that each charge 256 has a unique height relative to the end of the perforation gun 200 or in any other suitable configuration to generate the desired perforations, and the release capsules 276 may be spaced at vacant locations within the gun housing 252 between the charges 256. For example, the charges 256 may be arranged in a cluster or in bands so that multiple perforations may be formed at the same longitudinal distance from the end of the perforation gun, and the release capsules 276 may be placed at selected intervals between the charges 256.

The perforation gun 200 may be configured so that the charges 256 detonate one at a time, in unison, or as subsets that detonate in unison. The release capsules 276 may be configured to release the reactive material at a time that is earlier than, equivalent to, or later than the time of detonation of the charges 256. To facilitate release of the reactive material prior to detonation, the control line 270 may include a second control line that is coupled to the release capsules 276 and operable to transmit a control signal that causes the release capsules 276 to release the reactive material by, for example, opening a valve or activating an explosive to propel reactive material from the release capsule 276. Similarly, in an embodiment in which the release capsules 276 are configured to release the reactive material at the same time as detonation of the charges 252, the release capsules 276 may be actuated using the same control signal that causes the charges 252 to detonate. To facilitate release of the reactive material following detonation, the control line 270 may include a second control line that is coupled to the release capsules 276 and able to withstand detonation of the charges, or the release capsules may be configured to release the reactive material following a preselected time delay after detonation after receiving a control signal or in response to detecting a detonation. In an embodiment in which the release structures 276 release the reactive material upon or after detecting a detonation, the release structures 276 may include a microchip or microcontroller coupled to a sensor, such as an accelerometer or thermometer that detects a condition that is indicative of detonation (e.g., an impact or increase in temperature) and generates a controls signal that causes the release capsules to release the reactive material.

In another embodiment, the release capsules 276 may be replaced by a single release reservoir and one or more nozzles. Each of the nozzles may be placed at or near the locations of the release structures 276, as shown in FIG. 2, and each nozzle may be coupled to the release reservoir by a hose or other coupling to provide a release reactive material in fluid form to the nozzle. The operation of a configuration that includes a release reservoir and nozzles may be otherwise approximately analogous to the operation of a configuration that includes a plurality of release capsules 276.

Figure 2A:
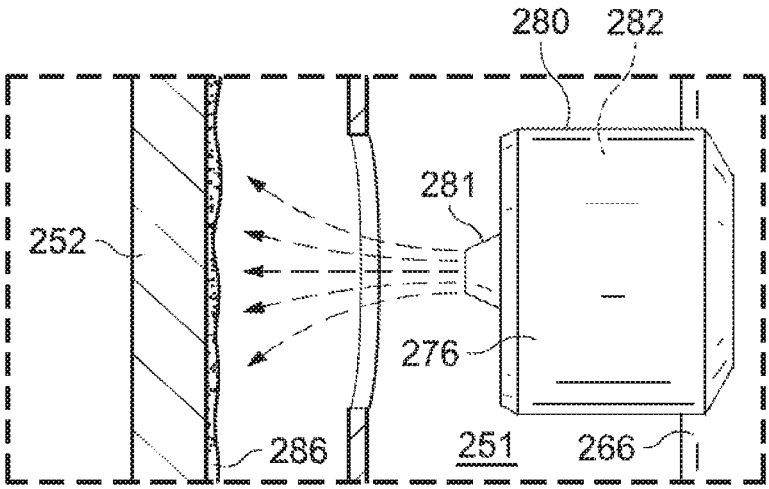
FIG. 2A is a detail view of a reactive charge of FIG. 2, in which the reactive charge includes a material or compressed fluid that is reactive with a coating applied to the interior of the perforation gun housing.

FIG. 2A shows a detail view of a release capsule 276, that is representative of the release capsules 276 shown in FIG. 2A. As shown, the release capsule 276 is placed within a cavity 251 of the gun housing 252 a nozzle 281 of the release capsule 276 is positioned at a preselected distance from an interior surface of the gun housing 252. A reactive material 282 is included within the release capsule 276, which may also include a reactive charge 280. The reactive material 282 may be a fluid, such as a compressed fluid or gas, or a solid, such as a powdered substance or other particulate. In an embodiment in which the reactive material 282 is a fluid, the reactive charge 280 may be a pressurized chamber that is at an increased pressure relative to the cavity 251 of the gun housing 252 to facilitate the dispersal of the reactive material 282 into the cavity 251 of the gun housing 252. As noted above, the reactive charge 280 may be coupled to the inner sleeve 266 of the gun housing 252 and may thereby be coupled to a control line for activation purposes.

In an embodiment, the reactive charge 280 is configured to disperse the reactive material 282 into the cavity 251 in response to an activation signal so that the reactive material 282 may react with a second reactive compound 286. In FIG. 2A, the second reactive compound 286 is shown as being applied as a coating to the inner surface of the gun housing 252. However, the second reactive compound 286 may also or instead be included as a fluid, such as a gas that occupies the cavity 251 or as a coating to an interior surface at the charge support structure 262. In another embodiment, the second reactive compound 286 may be stored within a second set of release capsules 276 that are otherwise analogous to release capsules 276 that include the reactive material 282. In such an embodiment, the release capsules 276 may be configured to release a reactive material 282 and second reactive compound 286 at approximately the same time to react with each other in an endothermic reaction. Further, as noted above with respect to the release capsules 276 shown in FIG. 2, the second reactive compound 286 may also be dispersed from a release reservoir that is coupled to one or more nozzles.

In an embodiment, the reactive material 282 and second reactive compound 286 may be selected to generate an endothermic chemical reaction when they come into contact with one another. In another embodiment, the reactive material 282 may be replaced by a compressed, compressible material that expands upon being released into the cavity 251, which may result in a temperature drop.

In an embodiment in which the reactive material 282 and second reactive compound 286 react in an endothermic reaction, the reactive material 282 and second reactive compound 286 may be any two materials that react with one another to generate the desired temperature or pressure drop. For example, in an embodiment, the reactive material 282 may be water and the second reactive compound 286 may be ammonium chloride. Other exemplary pairings may include water and potassium chloride; water and ammonium nitrate; ethanoic acid and sodium carbonate; water with carbon dioxide and chlorophyll; dry ammonium chloride and barium hydroxide octahydrate crystals; and thionyl chloride and cobalt (II) sulfate heptahydrate.

Figure 3:
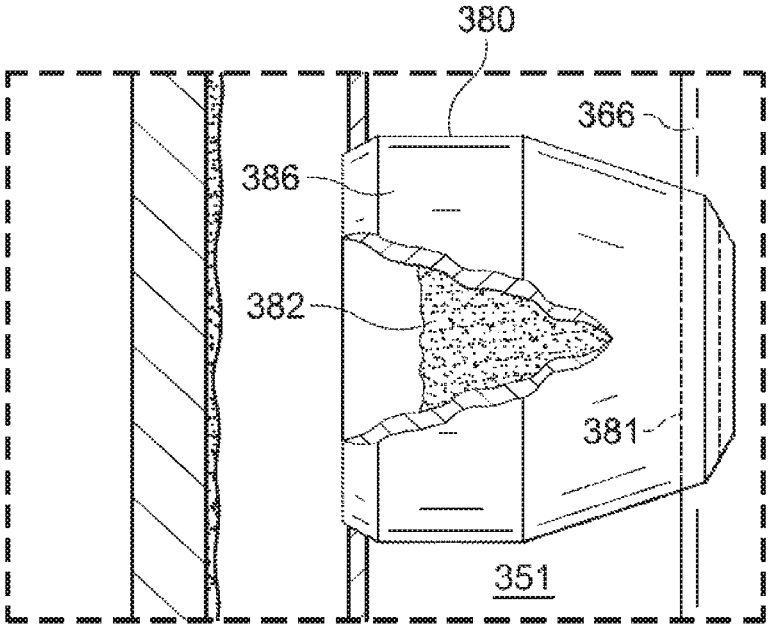
FIG. 3 is a detail view of an alternative embodiment of a reactive charge in which the reactive charge includes an explosive and a powder that is reactive with a coating applied to the interior of the perforation gun housing.

As shown in FIG. 3, in an embodiment in which the reactive compound includes a solid, powder, or particulate material, the reactive compound 382 may be placed in a reactive charge 380 that includes an open-faced release capsule 386 and is packed with an explosive 381 that may be activated to propel the reactive compound 382 into the cavity 351. The explosive may be activated using any suitable activation mechanism, including a detonator coupled to a control line via the inner sleeve 366 as discussed previously.

Applying the foregoing disclosure, a perforation gun, perforation gun assembly, and related methods are disclosed that may be implemented to cause a drop in the energy level of a perforation gun housing prior to, during, or following a detonation event.

In an exemplary embodiment, the perforation gun includes a gun housing, a plurality of charges, a first reactive material and a second reactive material that is reactive with the first reactive material to generate a chemical reaction. The perforation gun may further include a controller and a release capsule, with the first reactive material being disposed within the release capsule and the second reactive material being disposed within a chamber or cavity of the gun housing at a first time. The controller may be communicatively coupled to the release capsule and operable to generate a control signal to the release capsule at a second time that is later than the first time. The release capsule may be operable to release the first reactive material into the chamber in response to receiving the control signal.

The timing of the control signal may be adjusted to cause the release capsule to release the first reactive material after the detonation of at least one of the charges, prior to the detonation of all of the plurality of charges, or at approximately the same time as the charges.

In an embodiment, the control signal is generated in response to a trigger event, such as detonation of the charges, the controller receiving a voltage impulse from a control line, or the temperature of the release capsule reaching a threshold temperature.

According to another embodiment, a wellbore perforation system includes a surface controller, a perforation gun, and a control line that couples the surface controller to the perforation gun. The perforation gun includes a gun housing, a plurality of charges, a first reactive material, and a second reactive material that is reactive with the first reactive material to generate an endothermic chemical reaction.

In an embodiment, the well perforation system also includes a controller and a release capsule, and the first reactive material is disposed within the release capsule and the second reactive material is disposed within the gun housing at a first time. The surface controller is communicatively coupled to the controller, which is communicatively coupled to the release capsule and operable to generate a control signal to the release capsule at a second time that is later than the first time. The release capsule is operable to release the first reactive material into the chamber in response to receiving the control signal. The control signal may be timed to cause the first reactive material to be released at a second time that is after the detonation of at least one of the charges, at approximately the same time as the detonation of the charges, or before the detonation of all of the plurality of charges. In addition the controller may be operable to generate the control signal in response to a trigger event, which may be detonation of the charges, the controller receiving a voltage impulse from a control line, or an increase in the temperature of the release capsule to or beyond a threshold temperature. The first reactive material and second reactive material may be any of the combinations of materials described above.

According to another illustrative embodiment, a method for cooling a perforation gun includes deploying a first reactive material into a gun housing, and deploying a second reactive material into the gun housing, the second reactive material being reactive with the first reactive material to generate a chemical reaction. In the method, the step of deploying the first reactive material into the gun housing may include dispersing the first reactive material from a release capsule. Similarly, deploying the first reactive material into the gun housing may include using a controller to generate a control signal that causes the release capsule to disperse the first reactive material from a release capsule into the gun housing.

The method may further include detonating a charge of the perforation gun, and deploying the first reactive material into the gun housing may include dispersing the first reactive material from a release capsule after detonating the charge. In addition or in the alternative, the method may further include detonating a charge of the perforation gun, and the step of deploying the first reactive material into the gun housing may include dispersing the first reactive material from a release capsule before detonating the charge.

In an embodiment, the controller is operable to generate the control signal in response to a trigger event, which may be detonation of the charges, the controller receiving a voltage impulse from a control line, the temperature of the release capsule reaching a threshold temperature, the pressure near the release capsule reaching a threshold pressure or a combination of the foregoing.

As noted above, the first reactive material and second reactive material may be a fluid, powder, or other particulate. In an embodiment, the second reactive material includes a coating applied to an interior surface of the gun housing. The release capsule may be formed from a pressurized chamber and a nozzle. In an embodiment, the release capsule includes an explosive. As noted with respect to the systems and methods described above, the first reactive material and second reactive material are generally considered to be reactive with each other produce an energy absorbing, or endothermic reaction, and any of pairings of reactive materials and second reactive materials recited above may be used.

The illustrative systems, methods, and devices described herein may also be described by the following examples:

EXAMPLE 1

A perforation gun comprising:
a gun housing;
a plurality of charges;
a first reactive material; and
a second reactive material that is reactive with the first reactive material to generate a chemical reaction.

EXAMPLE 2

The perforation gun of example 1, further comprising:
a controller; and
a release capsule, the first reactive material being disposed within the release capsule and the second reactive material being disposed within a chamber of the gun housing at a first time;
wherein the controller is communicatively coupled to the release capsule, and operable to generate a control signal to the release capsule at a second time that is later than the first time;
wherein the release capsule is operable to release the first reactive material into the chamber in response to receiving the control signal.

EXAMPLE 3

The perforation gun of example 2, wherein the second time is after the detonation of at least one of the charges.

EXAMPLE 4

The perforation gun of example 2, wherein the second time is before the detonation of all of the plurality of charges.

EXAMPLE 5

The perforation gun of example 2, wherein the controller is operable to generate the control signal in response to a trigger event selected from the group consisting of detonation of the charges, the controller receiving a voltage impulse from a control line, and the temperature of the release capsule reaching a threshold temperature.

EXAMPLE 6

The perforation gun of example 1, wherein the first reactive material comprises a fluid.

EXAMPLE 7

The perforation gun of example 1, wherein the first reactive material comprises a powder.

EXAMPLE 8

The perforation gun of example 1, wherein the second reactive material comprises a fluid.

EXAMPLE 9

The perforation gun of example 1, wherein the second reactive material comprises a coating applied to an interior surface of the gun housing.

EXAMPLE 10

The perforation gun of example 1, wherein the release capsule comprises a pressurized chamber and a nozzle.

EXAMPLE 11

The perforation gun of example 1, wherein the release capsule comprises an explosive.

EXAMPLE 12

The perforation gun of example 1, wherein the chemical reaction is an endothermic reaction.

EXAMPLE 13

The perforation gun of example 1, the first reactive material comprises water and the second reactive material comprises ammonium chloride.

EXAMPLE 14

The perforation gun of example 1, the first reactive material comprises water and the second reactive material comprises potassium chloride.

EXAMPLE 15

The perforation gun of example 1, the first reactive material comprises water and the second reactive material comprises ammonium nitrate.

EXAMPLE 16

The perforation gun of example 1, the first reactive material comprises ethanoic acid and the second reactive material comprises sodium carbonate.

EXAMPLE 17

The perforation gun of example 1, the first reactive material comprises water and carbon dioxide and the second reactive material comprises chlorophyll.

EXAMPLE 18

The perforation gun of example 1, the first reactive material comprises dry ammonium chloride and the second reactive material comprises barium hydroxide octahydrate crystals.

EXAMPLE 19

The perforation gun of example 1, the first reactive material comprises thionyl chloride and the second reactive material comprises cobalt (II) sulfate heptahydrate.

EXAMPLE 20

A wellbore perforation system comprising:
a surface controller;

a perforation gun; and a control line; coupling the surface controller to the perforation gun;

wherein the perforation gun comprises a gun housing, a plurality of charges, a first reactive material, and a second reactive material that is reactive with the first reactive material to generate a chemical reaction.

EXAMPLE 21

The wellbore perforation system of example 20, wherein:

the perforation gun further comprises a controller and a release capsule;

the first reactive material is disposed within the release capsule and the second reactive material is disposed within the gun housing at a first time;

the surface controller is communicatively coupled to the controller;

the controller is communicatively coupled to the release capsule, and operable to generate a control signal to the release capsule at a second time that is later than the first time; and the release capsule is operable to release the first reactive material into the chamber in response to receiving the control signal.

EXAMPLE 22

The wellbore perforation system of example 21, wherein the second time is after the detonation of at least one of the charges.

EXAMPLE 23

The wellbore perforation system of example 21, wherein the second time is before the detonation of all of the plurality of charges.

EXAMPLE 24

The wellbore perforation system of example 21, wherein the controller is operable to generate the control signal in response to a trigger event selected from the group consisting of detonation of the charges, the controller receiving a voltage impulse from a control line, and the temperature of the release capsule reaching a threshold temperature.

EXAMPLE 25

The wellbore perforation system of example 20, wherein the first reactive material comprises a fluid.

EXAMPLE 26

The wellbore perforation system of example 20, wherein the first reactive material comprises a powder.

EXAMPLE 27

The wellbore perforation system of example 20, wherein the second reactive material comprises a fluid.

EXAMPLE 28

The wellbore perforation system of example 20, wherein the second reactive material comprises a coating applied to an interior surface of the gun housing.

EXAMPLE 29

The wellbore perforation system of example 20, wherein the release capsule comprises a pressurized chamber and a nozzle.

EXAMPLE 30

The wellbore perforation system of example 20, wherein the release capsule comprises an explosive.

EXAMPLE 31

The wellbore perforation system of example 20, wherein the chemical reaction is an endothermic reaction.

EXAMPLE 32

The wellbore perforation system of example 20, the first reactive material comprises water and the second reactive material comprises ammonium chloride.

EXAMPLE 33

The wellbore perforation system of example 20, the first reactive material comprises water and the second reactive material comprises potassium chloride.

EXAMPLE 34

The wellbore perforation system of example 20, the first reactive material comprises water and the second reactive material comprises ammonium nitrate.

EXAMPLE 35

The wellbore perforation system of example 20, the first reactive material comprises ethanoic acid and the second reactive material comprises sodium carbonate.

EXAMPLE 36

The wellbore perforation system of example 20, the first reactive material comprises water and carbon dioxide and the second reactive material comprises chlorophyll.

EXAMPLE 37

The wellbore perforation system of example 20, the first reactive material comprises dry ammonium chloride and the second reactive material comprises barium hydroxide octahydrate crystals.

EXAMPLE 38

The wellbore perforation system of example 20, the first reactive material comprises thionyl chloride and the second reactive material comprises cobalt (II) sulfate heptahydrate.

EXAMPLE 39

A method for cooling a perforation gun comprising:

deploying a first reactive material into a gun housing, deploying a second reactive material into the gun housing, the second reactive material being reactive with the first reactive material to generate a chemical reaction.

EXAMPLE 40

The method of claim 39, wherein deploying the first reactive material into the gun housing comprises dispersing the first reactive material from a release capsule.

EXAMPLE 41

The method of claim 39, wherein deploying the first reactive material into the gun housing comprises using a controller to generate a control signal that causes the release capsule to disperse the first reactive material from a release capsule.

EXAMPLE 42

The method of claim 39, further comprising detonating a charge of the perforation gun, wherein deploying the first reactive material into the gun housing comprises dispersing the first reactive material from a release capsule after detonating the charge.

EXAMPLE 43

The method of claim 39, further comprising detonating a charge of the perforation gun, wherein deploying the first reactive material into the gun housing comprises dispersing the first reactive material from a release capsule before detonating the charge.

EXAMPLE 44

The method of claim 41, wherein the controller is operable to generate the control signal in response to a trigger event selected from the group consisting of detonation of the charges, the controller receiving a voltage impulse from a control line, and the temperature of the release capsule reaching a threshold temperature.

EXAMPLE 45

The method of claim 39, wherein the first reactive material comprises a fluid.

EXAMPLE 46

The method of claim 39, wherein the first reactive material comprises a powder.

EXAMPLE 47

The method of claim 39, wherein the second reactive material comprises a fluid.

EXAMPLE 48

The method of claim 39, wherein the second reactive material comprises a coating applied to an interior surface of the gun housing.

EXAMPLE 49

The method of claim 39, wherein the release capsule comprises a pressurized chamber and a nozzle.

EXAMPLE 50

The method of claim 39, wherein the release capsule comprises an explosive.

EXAMPLE 51

The method of claim 39, wherein the chemical reaction is an endothermic reaction.

EXAMPLE 52

The method of claim 39, the first reactive material comprises water and the second reactive material comprises ammonium chloride.

EXAMPLE 53

The method of claim 39, the first reactive material comprises water and the second reactive material comprises potassium chloride.

EXAMPLE 54

The method of claim 39, the first reactive material comprises water and the second reactive material comprises ammonium nitrate.

EXAMPLE 55

The method of claim 39, the first reactive material comprises ethanoic acid and the second reactive material comprises sodium carbonate.

EXAMPLE 56

The method of claim 39, the first reactive material comprises water and carbon dioxide and the second reactive material comprises chlorophyll.

EXAMPLE 57

The method of claim 39, the first reactive material comprises dry ammonium chloride and the second reactive material comprises barium hydroxide octahydrate crystals.

EXAMPLE 58

The method of claim 39, the first reactive material comprises thionyl chloride and the second reactive material comprises cobalt (II) sulfate heptahydrate.

It should be apparent from the foregoing that an invention having significant advantages has been provided. While the invention is shown in only a few of its forms, it is not limited to only these embodiments but is susceptible to various changes and modifications without departing from the spirit thereof.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described to explain the principles of the invention and the practical application and to enable others of ordinary skill in the art to understand the invention for various embodiments with various modifications as are suited to the particular use contemplated. The scope of the claims is intended to broadly cover the disclosed embodiments and any such modification.

The invention claimed is:

1. A perforation gun, comprising:
a gun housing;
a plurality of charges;
a first reactive material;
a second reactive material that is reactive with the first reactive material to generate a chemical reaction; and
a release capsule, the first reactive material being disposed within the release capsule and the second reactive material being disposed within a chamber of the gun housing at a first time;
wherein the release capsule is communicatively coupled to a controller that generates a control signal to the release capsule at a second time that is later than the first time;
wherein the release capsule releases the first reactive material into the chamber in response to receiving the control signal; and
wherein the chemical reaction is an endothermic reaction.

2. The perforation gun of claim 1, wherein the controller generates the control signal in response to a trigger event selected from the group consisting of detonation of the charges and the temperature of the release capsule reaching a threshold temperature.

3. The perforation gun of claim 1, wherein the release capsule comprises a pressurized chamber and a nozzle.

4. The perforation gun of claim 1, the first reactive material comprises water and the second reactive material comprises ammonium chloride.

5. The perforation gun of claim 1, the first reactive material comprises water and the second reactive material comprises potassium chloride.

6. The perforation gun of claim 1, the first reactive material comprises water and the second reactive material comprises ammonium nitrate.

7. The perforation gun of claim 1, the first reactive material comprises ethanoic acid and the second reactive material comprises sodium carbonate.

8. The perforation gun of claim 1, the first reactive material comprises water and carbon dioxide and the second reactive material comprises chlorophyll.

9. The perforation gun of claim 1, the first reactive material comprises dry ammonium chloride and the second reactive material comprises barium hydroxide octahydrate crystals.

10. The perforation gun of claim 1, the first reactive material comprises thionyl chloride and the second reactive material comprises cobalt (II) sulfate heptahydrate.

11. The perforation gun of claim 1, wherein the controller comprises a control line and generates the control signal in response to the controller receiving a voltage impulse from the control line.

12. A wellbore perforation system, comprising:
a surface controller;
a perforation gun; and
a control line coupling the surface controller to the perforation gun;
wherein the perforation gun comprises a gun housing, a plurality of charges, a first reactive material, and a second reactive material that is reactive with the first reactive material to generate a chemical reaction;
wherein the perforation gun further comprises a controller and a release capsule;
wherein the first reactive material is disposed within the release capsule and the second reactive material is disposed within the gun housing at a first time;
wherein the surface controller is communicatively coupled to the controller;
wherein the controller is communicatively coupled to the release capsule, and generates a control signal to the release capsule at a second time that is later than the first time;
wherein the release capsule releases the first reactive material into the chamber in response to receiving the control signal; and
wherein the chemical reaction is an endothermic reaction.

13. The wellbore perforation system of claim 12, wherein the first reactive material comprises a fluid.

14. The wellbore perforation system of claim 12, wherein the first reactive material comprises a powder.

15. The wellbore perforation system of claim 12, wherein the second reactive material comprises a coating applied to an interior surface of the gun housing.

16. A method for cooling a perforation gun having a gun housing and a plurality of charges, comprising:
deploying a first reactive material into the gun housing from a release capsule upon the release capsule receiving a control signal from a controller;
deploying a second reactive material into the gun housing, the second reactive material being reactive with the first reactive material to generate a chemical reaction, wherein the chemical reaction is an endothermic reaction, thereby cooling the perforation gun.

17. The method of claim 16, further comprising detonating a charge of the perforation gun, wherein deploying the first reactive material into the gun housing comprises dispersing the first reactive material from the release capsule after detonating the charge.

* * * * *